United States Patent [19]

Ohyaba et al.

[11] Patent Number: 4,504,704

[45] Date of Patent: Mar. 12, 1985

[54] LOUDSPEAKER SYSTEM

[75] Inventors: Takashi Ohyaba; Minoru Kamishima; Shozo Kinoshita; Tetsuo Kawamura; Hiroaki Matsuhisa, all of Saitama, Japan

[73] Assignee: Pioneer Electronic Corporation, Tokyo, Japan

[21] Appl. No.: 527,722

[22] Filed: Aug. 30, 1983

[30] Foreign Application Priority Data

Aug. 31, 1982 [JP] Japan ..... 57-131720[U]

[51] Int. Cl.[3] ..... H04R 3/08

[52] U.S. Cl. ..... 179/115.5 DV; 381/117

[58] Field of Search ..... 179/115.5 DV, 115.5 VC, 179/115.5 R; 381/117

[56] References Cited

U.S. PATENT DOCUMENTS

| | | | |
|---|---|---|---|
| 2,007,746 | 7/1935 | Ringel | 179/115.5 DV |
| 2,007,748 | 7/1935 | Olson | 179/115.5 DV |
| 2,007,749 | 7/1935 | Anderson | 179/115.5 DV |
| 3,055,991 | 9/1962 | Guss | 179/115.5 DV |
| 3,838,216 | 9/1974 | Watkins | 179/115.5 DV |
| 4,201,886 | 5/1980 | Nagel | 179/115.5 DV |
| 4,335,274 | 6/1982 | Ayers | 179/115.5 DV |

FOREIGN PATENT DOCUMENTS

| | | | |
|---|---|---|---|
| 892396 | 1/1944 | France | 179/115.5 DV |
| 53-26117 | 3/1978 | Japan | 179/115.5 DV |
| 55-25265 | 2/1980 | Japan | 179/115.5 DV |

*Primary Examiner*—Gene Z. Rubinson
*Assistant Examiner*—L. C. Schroeder
*Attorney, Agent, or Firm*—Sughrue, Mion, Zinn, Macpeak & Seas

[57] ABSTRACT

A dynamic loudspeaker unit having a voice coil formed with two windings in which a capacitor is connected in series to a parallel circuit, one circuit arm being composed of a series circuit of one of the two windings and an inductor and the other circuit arm being composed of the remaining winding. The dynamic loudspeaker unit thus constructed is housed in a bass-reflex type cabinet, whereby a shoulder characteristic having a large Q in a bass zone can be obtained, and due to a combination of the inductor and the capacitor, a desired lowest resonance frequency lower than an actual lowest resonance frequency can be selected. Thus, the reproducible bass range can be extended.

6 Claims, 15 Drawing Figures

LOUDSPEAKER SYSTEM

BACKGROUND OF THE INVENTION

The present invention relates generally to a loudspeaker system, and more particularly, to a dynamic loudspeaker unit which includes a voice coil consisting of two windings and is designed to lower a reproducible threshold frequency in a bass zone or low sound frequency zone.

A prior art loudspeaker system of the type mentioned above is shown in FIG. 1. Principles of the loudspeaker system shown therein are as follows: It includes a dynamic loudspeaker in which a voice coil 1 consisting of a first winding 1*a* and a second winding 1*b* is coupled to a diaphragm 2 and the windings are positioned within a magnetic gap of a magnetic circuit. Between input terminals 3, 3', a first circuit including the first winding 1*a* and a second circuit including the second winding 1*b* are connected in parallel. To the first winding 1*a* of the first circuit, an LC series resonance circuit consisting of an inductor L and a capacitor C is connected in series. A resonance frequency of the LC series resonace circuit is selected to be approximately equal to the lowest resonance frequency $f_{oc}$ of the loudspeaker unit. Accordingly, at frequencies around the lowest resonance frequency $f_{oc}$, currents will flow through not only the second winding 1*b* but also the first winding 1*a*, so that a sound pressure level of the loudspeaker at the frequency around the lowest resonance frequency $f_{oc}$ is increased, resulting that apparent resonance quality factor $Q_{oc}$ of the loudspeaker is increased.

A sound pressure characteristic A of the loudspeaker thus constructed is shown in FIG. 2 where a characteristic B of a loudspeaker having a voice coil consisting of a single winding is also shown for the purpose of comparison. Further, an impedance characteristic A of the former loudspeaker is shown in FIG. 3 together with a characteristic B of the latter one. It is understood from FIG. 3 that the impedance characteristic A is made flat over the entire sound frequency zone.

As noted above, in this loudspeaker system, the lowest resonance frequency $f_{oc}$ is not altered but only apparent $Q_{oc}$ is only changed. Therefore, in order that sound may be reproduced to a lower frequencies, it is necessary to increase the weight of a vibrating system, to thereby lower $f_{oc}$. As a result, the sound pressure level will drop. Thus, in order to maintain the initial sound pressure level, a larger driving force, i.e., force coefficient Bl (B being a magnetic flux density in a magnetic gap and l being an effective length of a voice coil) is needed. If so designed, then $Q_{oc}$ is lowered and as a consequence, a wanted rise of the sound pressure level can not be obtained.

In addition, due to lowering of an impedance as shown in FIG. 3, the load of a driving amplifier becomes heavy and generation of heat from the amplifier becomes significant.

SUMMARY OF THE INVENTION

In view of the foregoing, it is an object of this invention to provide a dynamic loudspeaker unit in which a reproducible frequency band can in substance be extended toward a bass zone.

The dynamic loudspeaker unit according to this invention includes a voice coil formed with two windings, each being wound around a voice coil bobbin wherein one of the two windings is connected in series to an inductor to form a series circuit which is connected in parallel to the remaining winding, and to such a parallel circuit a capacitor is connected in series.

DETAILED DESCRIPTION OF THE PREFERRED EMBODIMENTS

Figure 1:
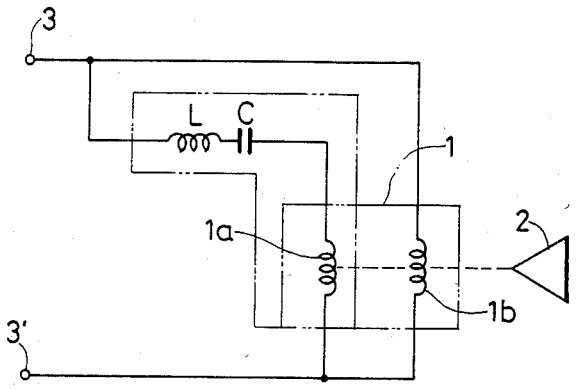
FIG. 1 PRIOR ART
FIG. 1 is a circuit diagram showing a prior art loudspeaker unit.
Figure 2:
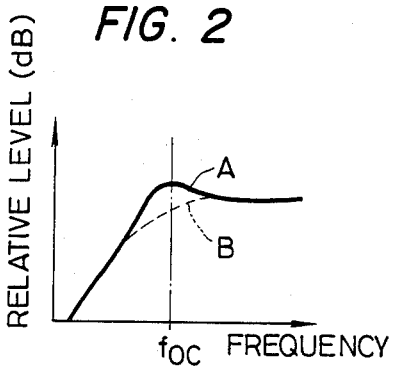
FIGS. 2 and 3 are graphical representations showing characteristics of the loudspeaker unit shown in FIG. 1.
Figure 3:
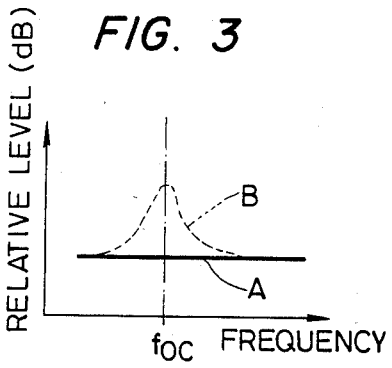

A preferred embodiment of this invention will be described with reference to FIG. 4 et seq. wherein same reference numerals or same symbols as used in FIG. 1 denote same portions or components.

Figure 4:
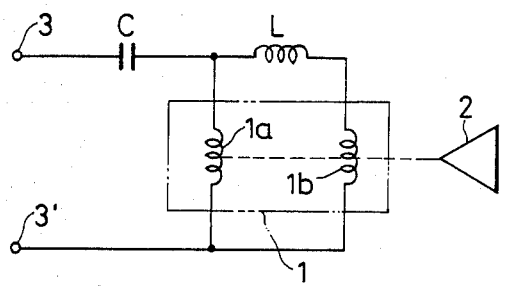
FIG. 4 is a circuit diagram showing a fundamental circuit arrangement of the loudspeaker unit according to this invention.

In FIG. 4, a loudspeaker unit is similar to that of FIG. 1 in that a voice coil 1 is composed of a first winding 1*a* and a second winding 1*b* coiled around a bobbin, the voice coil 1 is coupled to a diaphragm 2, and the windings are positioned within a magnetic gap of a magnetic circuit.

One end of the first winding 1*a* is connected between a capacitor C and an inductor L, and to the inductor L one end of the second winding 1*b* is connected. The other ends of the first and second windings 1*a* and 1*b* are directly connected to a signal return line. A dynamic loudspeaker thus wired is housed in a bass-reflex type cabinet.

Figure 5:
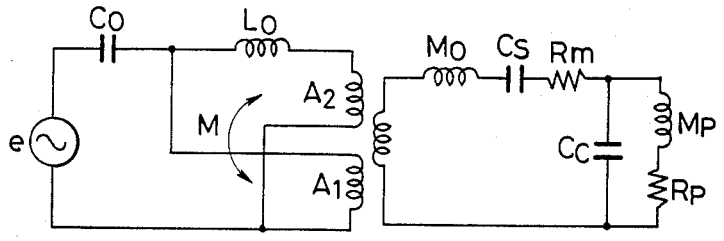
FIG. 5 is an equivalent circuit diagram in the case when the loudspeaker unit shown in FIG. 4 is housed in a bass-reflex type cabinet.

An equivalent circuit of such a loudspeaker unit in FIG. 4 is as shown in FIG. 5 in which e is a voltage of a signal source having an angular frequency $\omega$, $C_o$ is a capacitance of the capacitor C, $L_o$ is an inductance of the inductor L, M is a mutual inductance between the first and second windings 1a and 1b, $A_1$ is a force coefficient ($=Bl_1$) of the first winding 1a, $A_2$ is a force coefficient ($=Bl_2$) of the second winding 1b, $Z_m$ is a mechanical impedance of a vibrating system, $M_o$ is an equivalent mass of the vibrating system, $C_s$ is an equivalent compliance of a supporting system, $R_m$ is a mechanical resistance of the supporting system, $C_c$ is an equivalent compliance of a cabinet, $M_p$ is an equivalent mass of a bass-reflex duct, and $R_p$ is an equivalent mechanical resistance of the bass-reflex duct. To known a sound pressure-frequency characteristic, it is necessary to obtain a volume velocity $V_c$ passing through the compliance $C_c$ of the cabinet. This can be calculated as follows:

$$V_c = A/B$$
$$A = \{X_7 X_1 - Y_7 Y_1 + j(Y_7 X_1 + Y_1 X_7)\}\{A_1 X_4 + A_2 X_5 + j(A_1 Y_4 + A_2 + Y_5)\}$$
$$B = \{X_7 X_3 - Y_8 Y_3 + j(X_7 Y_3 + Y_8 X_3)\}[X_6 X_5 - Y_6 Y_5 + A_1(A_1 - A_2) + j(Y_6 Y_5 + X_6 Y_5) - \{(X_7 X_2 - Y_8 Y_2) + j(X_7 Y_2 + Y_8 X_2)\}]\{A_1 X_4 + A_2 X_5 + j(A_1 Y_4 + A_2 Y_5)\}$$

wherein $$X_1 = \omega^2 M C_0 e$$
$$Y_1 = \omega C_0 R_1 e$$
$$X_2 = A_1(1 - \omega^2 M C_0) - A_2$$
$$Y_2 = -\omega C_0 R_1 A_2$$
$$X_3 = R_1(1 - \omega^2 L_0 C_0) + R_2$$
$$Y_3 = \omega\{L_0 - 2M + C_0(R_1 R_2 + \omega^2 M^2)\}$$
$$X_4 = R_2$$
$$Y_4 = \omega(L - M)$$
$$X_5 = R_1$$
$$Y_5 = -\omega M$$
$$X_6 = R_m + \frac{R_p}{(1 - \omega^2 M_p C_c)^2 + \omega^2 C_c^2 R_p^2}$$
$$Y_6 = \omega M_0 - \frac{1}{\omega C_s} + \frac{\omega M_p(1 - \omega^2 M_p C_c) - C_c R_p^2}{(1 - \omega^2 M_p C_c)^2 + \omega C_c R_p^2}$$
$$X_7 = R_p$$
$$Y_7 = \omega M_p$$
$$Y_8 = \omega M_p - \frac{1}{\omega C_s}$$

The sound pressure characteristic will be obtained by the following formula:

$$|P| = \omega\rho |V_c| S/2\pi r$$

wherein P is an air density, S is an area of the diaphragm and r is a distance.

Figure 6:
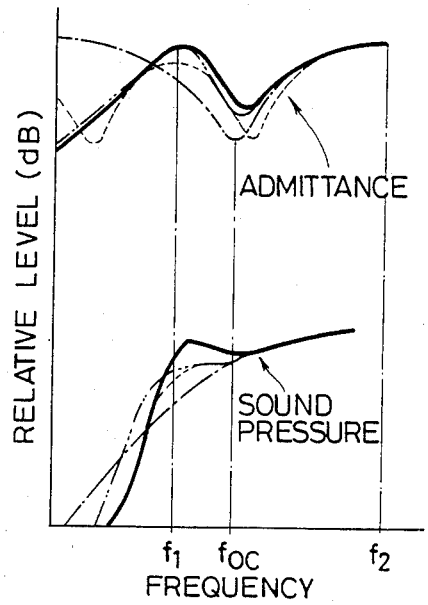
FIG. 6 is a graphical representation showing comparative characteristics.

The loudspeaker unit having the equivalent circuit as shown in FIG. 5 will be described with reference to admittance and sound pressure characteristics shown in FIG. 6. In this figure, one-dotted broken lines represent characteristics obtained when a loudspeaker having a voice coil consisting of a single winding is housed in a closed-type cabinet, wherein the lowest resonance frequency $f_{oc}$ of the system under the resonance quality factor $Q_{oc} \simeq 0.5$, is in a position as shown. When the same loudspeaker unit is housed in a bass-reflex type cabinet having the same inner volume sas that of the closed-type cabinet, and if a resonance frequency $f_1$ of a duct is selected to a value as shown, this system exhibits characteristics as shown by dotted lines in the figure. Thus, it will be understood that the frequency at the maximum admittance coincides with $f_1$, a reproducible threshold frequency of a bass zone in the sound pressure characteristic is approximately equal to $f_1$, and an apparent Q, i.e., the sound pressure, becomes high.

On the other hand, in the case of the loudspeaker unit according to the invention, increasing of driving force or level up of the sound pressure level can be achieved (as shown by solid line) owing to the capacitance $C_o$ and an equivalent inductance ($L_e$) including inductance $L_o$ and an equivalent inductance component of a mechanical circuit. This can also be noted from the solid line showing the admittance characteristic wherein the curve is maximum at frequency $f_1$. Two-dotted broken lines show characteristics obtained when the loudspeaker unit shown in FIG. 4 is housed in a closed type cabinet. As will be clear form the comparison of those characteristics, the admittance characteristic of the bass-reflex type system is superior to that of the closed type system in that the former characteristic curve is lower on the bass zone side defined by the frequencies lower than frequency $f_1$, and is higher on the treble zone side. The foregoing is also true for the sound pressure level.

It is confirmed through experimentations that, at frequency $f_1$, the sound pressure can be increased if a larger amount of current if flown through the second winding 1b. An optimum value to achieve this can be established by the selection of force coefficients $A_1$ and $A_2$ of the first and second windings 1a and 1b, and direct-current resistances $R_1$ and $R_2$.

Through simulation, it is recognized that the best effect can be obtained if $A_1$: $A_2 = 1$: $0.25 \sim 0.5$, and further increasing effect of the second pressure can be enhanced if both direct-current resistances of the first and second windings are smaller. However, if so selected, and admittance becomes excessively large as to increase an actual electric input, i.e., to increase an output of a driving amplifier. Therefore, it is desirable that the maximum value of the admittance at $f_1$ be set nearly equal to an admittance value of a middle sound frequency zone.

Figure 7:
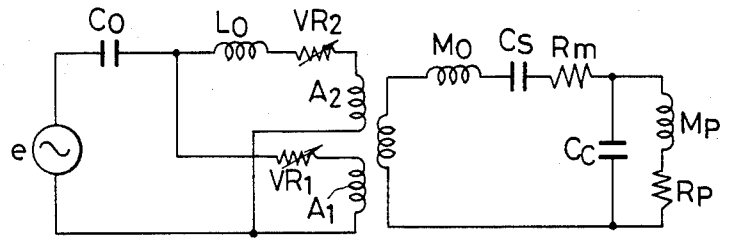
FIG. 7 is an equivalent circuit diagram in the case when variable resistors are inserted in the respective winding circuits of FIG. 5.
Figure 8A:
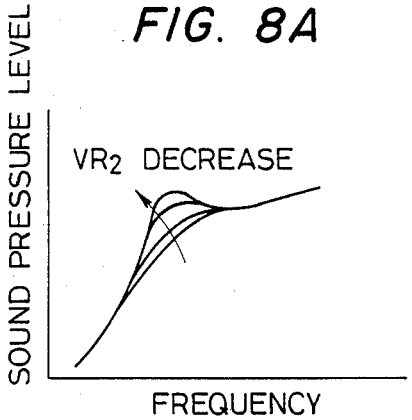
FIGS. 8A and 8B are graphical representations showing changes in the sound pressure levels caused by changing the variable resistors shown in FIG. 7.
Figure 8B:
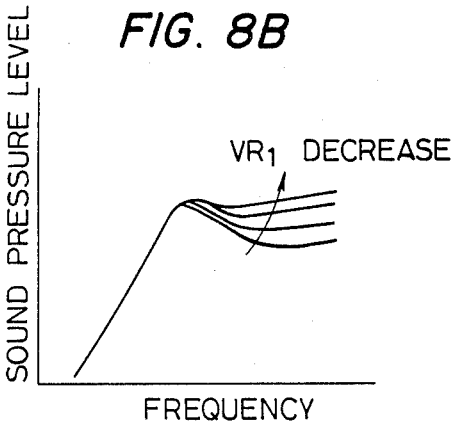

FIG. 7 shows another embodiment of the invention wherein variable resistors $VR_1$ and $VR_2$ are further connected in series to the respective windings. By changing the variable resistors $VR_1$ and $VR_2$, the base zone characteristic can essily be changed as shown in FIGS. 8(*a*) and 8(*b*). Espcially, because $VR_2$ can control arbitrarily a so-called shoulder characteristic in the lowest sound frequency zone, this means is effective to eliminate the situation where a characteristic peak appears in the bass zone due to a standing wave in a room where a loudspeaker is disposed. On the other hand, $VR_1$ can control the level in the middle and low sound frequency zone without changing substantially the shouler characteristic in the lowest sound frequency zone, so that this means is effective to eliminate "boomy" bass due to excessive sound volume in the middle and low sound frequency zone that will likely appear if the loudspeaker is positioned closely to a wall or built in the wall or located at a corner of a room.

In the embodiment shown, $VR_1$ and $VR_2$ are the variable resistors of a so-called continuously changeable type. However, it will be appreciated that these resistors can be comprised of a combination of fixed resistors and switches. Further, $VR_1$ and $VR_2$ may be of an independetly variable type or an interlocking type.

Figure 9:
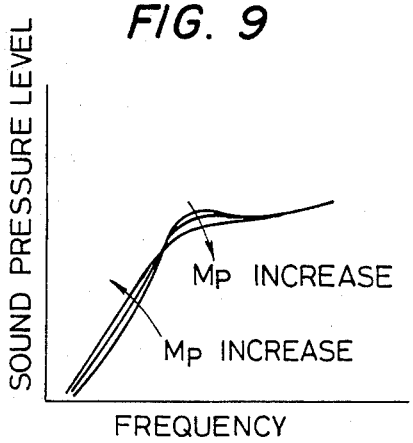
FIG. 9 is a graphical representation showing the sound pressure characteristics of the unit shown in FIG. 5 in the case when duct conditions are changed.

FIG. 9 shows changes in the sound pressure characteristic in the case where the bass reflex conditions are changed, i.e., an entire length L and an opening area $S_p$ of the duct are changed. If equivalent mass $M_p$ of the duct increases, apparent Q becomes small, however, the reproducible threshold frequency in the bass zone lowers. Conversely, if $M_p$ is made small, apparent Q increases and the reproducible threshold frequency in the bass zone rises.

Figure 10:
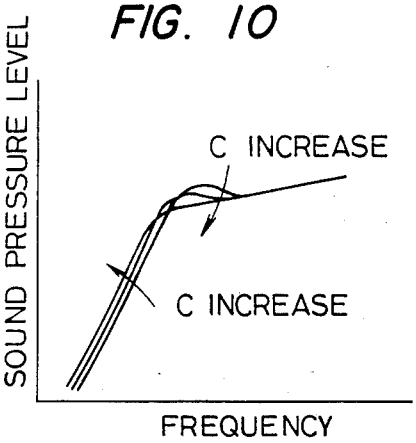
FIG. 10 is a graphical representations showing the sound pressure characteristic of the unit shown in FIG. 5 in the case when $C_o$ is changed under a duct opening being fully closed.

As a means for changing $M_p$, a slide type duct or joint type duct as conventionally used are available. As a means for varying the opening area, a shutter as conventionally used in available. In the latter case, by setting the shutter in a closed condition so as to operate the device under a closed type state and by making the value $C_o$ of the capacitor large, the reproducible frequency range can further be extended toward the bass zone side as shown in FIG. 10.

As described above, dynamic loudspeaker unit according to the present invention includes a voice coil formed with to windings, a capacitor is serially connected to a parallel circuit, one circuit arm of which is composed of a series circuit of one of the two windings and an inductor and the other circuit arm being composed of the remaining winding. The dynamic loudspeaker unit thus constructed is housed in a bass-reflex type cabinet. Therefore, in comparison with a system in which a loudspeaker unit having a voice coil formed with a single winding is housed in a bass-reflex type cabinet or another system in which a loudspeaker unit having two windings is stored in a bass-reflex type cabinet, according to loudspeaker system of the present invention, is obtainable a shoulder characteristic having a larger actual Q in the bass zone, is selectable a desired lowest resonance frequency lower than an actual lowest resonance frequency by a combination of the inductor and the capacitor, and a reproducible bass band can largely be extended. By increasing a mass of a vibrating system, it is further possible to raise a sound pressure level and enhance an efficiency in comparison with those of the device having the extended reproducible bass band. Thus, the magnetic circuit can be made smaller than that of the device having the same sound pressure level, resulting in an economical structure. Further, in comparison with a loudspeaker unit having a similar reproducible bass zone, a loudspeaker having a sharply raising characteristic favourable for reproduction of middle and high sound frequency zones can be produced, because the weight of the vibrating system can be reduced. Furthermore, because lowering of a sound pressure response in a very low sound frequency zone is very sharp, an excessive vibration amplitude of a cone due to an unwanted very low sound input caused by warp of a disc and the like is suppressed, and generation of cross modulation is prevented.

Although it has been described in the case where the dynamic loudspeaker unit formed as shown in FIG. 4 or 7 is housed in the bass-reflex type cabinet, it should be noted that the present invention is not limited thereto or thereby. Similar advantages as obtained in the foregoing embodiment are also obtainable in the case where the loudspeaker unit is housed in a closed type cabinet.

Next, description will be made with respect to a connection of the loudspeaker unit in accordance with the present invention when used as a low-range speaker.

Figure 11:
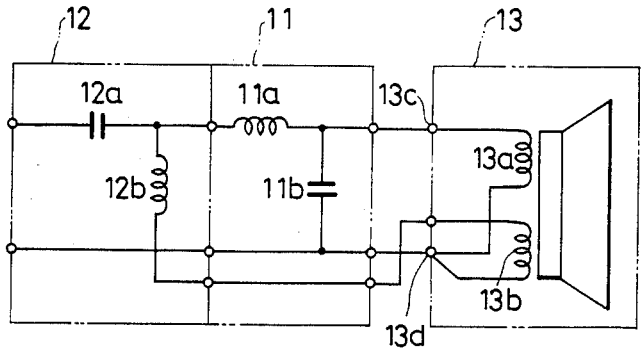
FIG. 11 is a circuit diagram showing electrical connections of the loudspeaker unit according to this invention.
Figure 12:
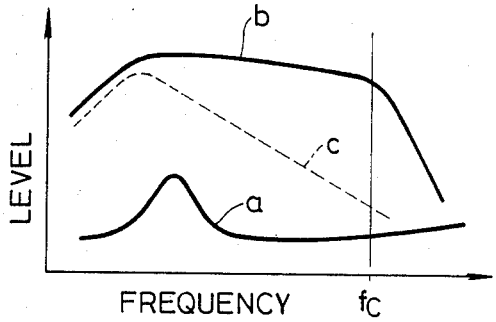
FIG. 12 is a graphical representation showing characteristic of the loudspeaker system shown in FIG. 11.
Figure 13:
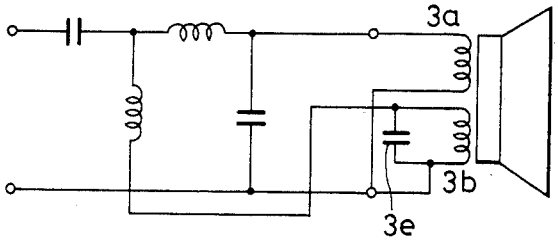
FIG. 13 is a circuit diagram showing a modified connections of the loudspeaker unit according to this invention.

Referring to FIG. 11 in which connection of the loudspeaker unit to its associated network is shown, a low-pass filter 11 composed of an inductor 11*a* and a capacitor 11*b* is connected between an intensification circuit 12 and the loudspeaker unit 13. A load of the low-pass filter 11 is an impedance of the loudspeaker unit 13 imposed between input terminals 13*c* and 13*d* where only a first coil 13*a* of the loudspeaker unit 13 is connected. A second coil 13*d* is directly connected to the intensification circuit 12. With such a connection, the load of the low-pass filter 11 is only the first coil 13*a*, an impedance characteristic of which is shown by a curve a in FIG. 12. As can be appreciated from the curve a, the level difference in the middle and high frequency zone is reduced. Accordingly, a transfer characteristic of an input signal after passing through the low-pass filter 11 involves few errors relative to a cut-off frequency $f_c$ being set. Further, since an inductor 12*b* having a large inductance value is connected in series to the second coil 13*b* having a low impedance, a sufficient amount of attenuation is obtainable in the middle and high frequency zone. Therefore, it is not necessary that the signal to be applied to the second coil 13*b* be passed through the low-pass filter 11. A transfer characteristic of the second coil 13*b* is shown by curve c in FIG. 12.

The low-pass filter as used in the circuit of FIG. 11 has an attenuation inclination of 12 dB/oct. However, it is apparent that low-pass filters of 6dB/oct or 18 dB/oct, etc. are usable.

Figure 14:
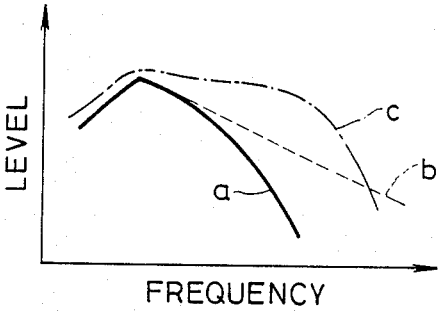
FIG. 14 is a graphical representation showing characteristics of the loudspeaker connected as shown in FIG. 13.

As described, the input signal fed to the second coil 13*b* is sufficiently attenuated in the high frequency zone, however, the attenuation inclination characteristic is of basically 6 dB/oct type, there may be a case where sufficient attenuation characteristic is not obtained in the middle frequency range. In such a case, a large amount of attenuation is obtained if both ends of the second coil 13*b* are short-circuited by a capacitor 13*e* while not affecting to the intensification circuit. With the insertion of the capacitor 13*e*, the transfer characteristic of the second coil becomes as shown by a curve a in FIG. 14. In comparison with the curve b which is a characteristic obtained in the case where the capacitor is not inserted, the level in the high frequency range in the curve a is lowered. A curve c shown in FIG. 14 is a transfer characteristic of the first coil 13*a*.

According to the connection of the loudspeaker unit as described, it is advantageous in that variation in the impedance of the low-pass filter's load depending upon the variation in the frequency is reduced, and a desirable filter characteristic is obtained without employing impedance amending element, or the like.

What is claimed is:

1. A loudspeaker system including a dynamic loudspeaker unit, said loudspeaker unit comprising: a bobbin; a voice coil having first and second windings both wound around said bobbin, said first winding being connected in series to an inductor to form a series circuit, said series circuit and said second winding forming a parallel circuit; and a capacitor connected in series to said parallel circuit.

2. A loudspeaker system as claimed in claim 1, further comprising a first variable resistor interposed between said first winding and said inductor of said series circuit, and a second variable resistor connected in series to said second winding.

3. A loudspeaker system as claimed in claim 1, wherein said loudspeaker unit is housed in a bass-reflex type cabinet.

4. A loudspeaker system as claimed in claim 1, wherein said loudspeaker unit is housed in a closed type cabinet.

5. A loudspeaker system as claimed in claim 2, wherein said loudspeaker unit is housed in a bass-reflex type cabinet.

6. A loudspeaker system as claimed in claim 2, wherein said loudspeaker unit is housed in a closed type cabinet.

* * * * *